United States Patent [19]

Oellers

[11] Patent Number: 4,693,066

[45] Date of Patent: Sep. 15, 1987

[54] COMPRESSED AIR THREAD SPLICING DEVICE

[75] Inventor: Dieter Oellers, Monchen-Gladbach, Fed. Rep. of Germany

[73] Assignee: W. Schlafhorst & Co., Monchen-Gladbach, Fed. Rep. of Germany

[21] Appl. No.: 866,059

[22] Filed: May 21, 1986

[30] Foreign Application Priority Data

May 22, 1985 [DE] Fed. Rep. of Germany ..... 3518315

[51] Int. Cl.[4] ..... D01H 15/00; B65H 69/06; D02J 1/08

[52] U.S. Cl. ..... 57/22; 57/261

[58] Field of Search ..... 57/22, 261, 263

[56] References Cited

U.S. PATENT DOCUMENTS 4,414,798 11/1983 Matsui et al. ..... 57/22

4,445,317 5/1984 Mima ..... 57/22

4,492,076 1/1985 Romic et al. ..... 57/22

4,507,912 4/1985 Noguchi ..... 57/22

*Primary Examiner*—Donald Watkins

*Attorney, Agent, or Firm*—Herbert L. Lerner; Laurence A. Greenberg

[57] ABSTRACT

A compressed air thread splicing device for producing a thread connection by splicing includes a splicing chamber having at least one opening formed therein through which compressed air is blown into the splicing chamber for mutually entangling, hooking, intermingling and winding fibers of threads to be spliced together in the splicing chamber, pneumatic holding devices disposed at two sides of the splicing chamber for holding ends of the threads to be prepared for splicing, each of the holding devices having a channel for receiving a thread end and a lateral opening for receiving injection air generating a holding air current, flow channels pointing in different discharge directions, and a device for alternately conducting the injection air through the flow channels to the lateral opening for determining the discharge direction of the injection air.

2 Claims, 14 Drawing Figures

COMPRESSED AIR THREAD SPLICING DEVICE

The invention relates to a compressed air thread splicing device for producing a thread connection by splicing, including a splicing chamber having at least one opening formed therein through which compressed air is blown into the splicing chamber for mutually entangling, hooking, intermingling and/or winding fibers of threads to be spliced in the splicing chamber, and pneumatic holding devices disposed at both sides of the splicing chamber for holding thread ends during thread preparation, each holding device having a channel for accepting the thread end and a lateral opening for injection air generating a holding air current.

The injection air flows tangentially into the channel which holds the thread end, with an axial component. Since the thread ends have to be prepared in the shortest possible time, it is necessary to adjust the air admission direction to suit the respective yarn or thread twist. This has been accomplished heretofore by exchanging the holding devices, which is very time consuming.

It is accordingly an object of the invention to provide a compressed air thread splicing device which overcomes the hereinafore-mentioned disadvantages of the heretofore-known devices of this general type, and to permit a quick and effective preparation of thread ends which have different yarn twists by providing different tangential injection air admission directions which are adjusted to the respective yarn twist, without the need to exchange any parts in order to accomplish this purpose and without changing the positions of the pneumatic holding devices.

With the foregoing and other objects in view there is provided, in accordance with the invention, a compressed air thread splicing device for producing a thread connection or joint by splicing, comprising a splicing chamber having at least one opening formed therein through which compressed air is blown into the splicing chamber for mutually entangling, hooking, intermingling and/or winding around fibers of threads to be spliced together in the splicing chamber, pneumatic holding devices disposed at both sides of the splicing chamber for holding and preparing ends of the threads to be prepared for splicing, each of the holding devices having a channel for receiving a thread end and a lateral opening for receiving injection air generating a holding air current, flow channels pointing in two different discharge directions, and means for alternately conducting the injection air through the flow channels to the lateral opening for determining the discharge direction of the injection air.

According to the invention, the lateral opening which conducts the injection air of the pneumatic holding device does not determine the direction of the injection air stream alone, but rather the flow channels associated with this opening determine the direction of the injection air jet.

In accordance with another feature of the invention, the pneumatic holding devices hold the thread ends at a given location between the pneumatic holding devices and the splicing chamber, the flow channels have ends, and the ends of the flow channels and the lateral openings are disposed substantially below the given location. This construction is of great advantage with respect to the speed and effectiveness of the thread end preparation.

In accordance with a further feature of the invention, there is provided a compressed air supply channel and a slider having the air flow channels formed therein for each of the holding devices, the injection air conducting means being in the form of means for shifting the slider between a first position in which one of the flow channels is connected to the compressed air supply channel and a second position in which the other of the flow channels is connected to the compressed air supply channel. The change required for producing different yarn twists is achieved by simply shifting the slider.

In accordance with a concomitant feature of the invention, the pneumatic holding devices have a plane of symmetry, the compressed air supply channels are mirror-symmetrical, have the same length, have the same cross section and are free of obstructions, and including a main channel in the plane of symmetry being connected to the compressed air supply channels. In order to prepare the thread ends uniformly, it is desirable for the pneumatic action on both sides to be approximately the same.

This construction must be carefully planned and is not obvious, because as a rule the supply line for splicing air flowing to the splicing chamber also lies in the symmetry plane of the pneumatic holding devices. It is desirable for the splicing air to be separated as much as possible from the injection air.

Other features which are considered as characteristic for the invention are set forth in the appended claims.

Although the invention is illustrated and described herein as embodied in a compressed air thread splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
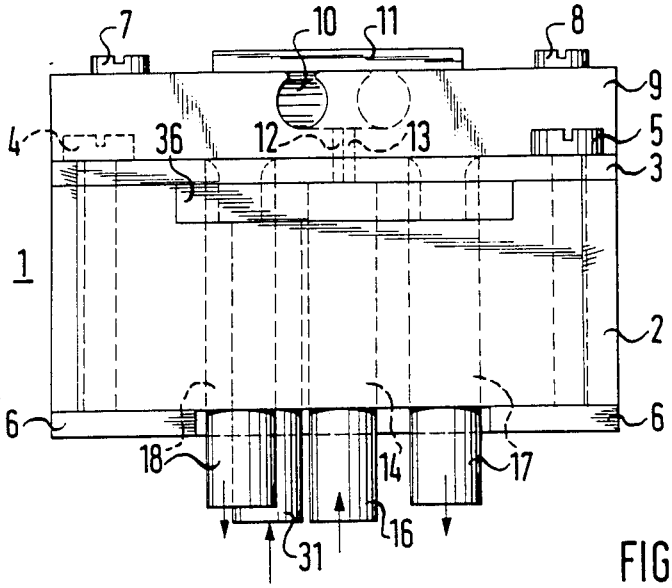
FIG. 2 is an elevational view of the compressed air splicing device taken along the direction "a" in FIG. 1.
Figure 1:
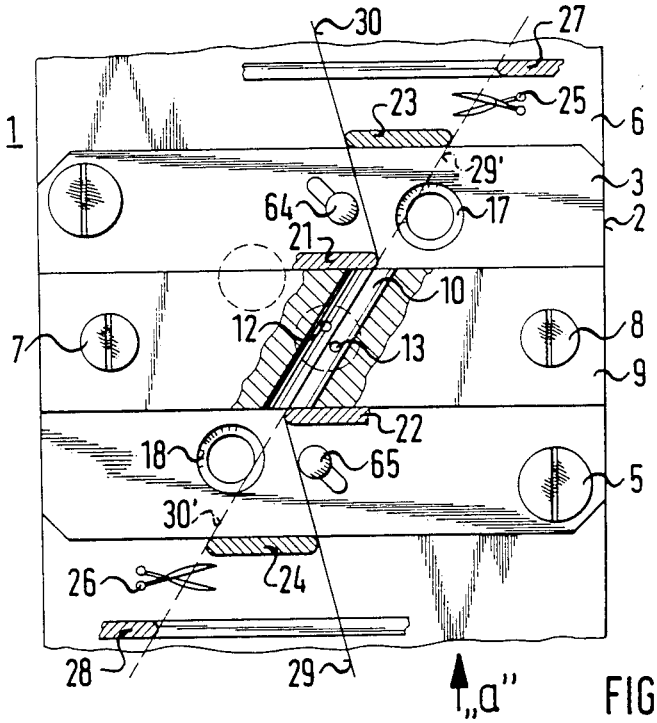
FIG. 1 is a fragmentary, diagrammatic, front-elevational view of a compressed air thread splicing device according to the invention, which is partly broken away.

Referring now in detail to the figures of the drawings and first, particularly to FIGS. 1 and 2 thereof, there is seen a compressed air splicing device designated as a whole with reference numeral 1 which only contains the parts that are essential for the invention. The splicing device is formed of a basic body 2, which is fastened to a cover plate 3 by two screws 4, 5 in a machine frame 6. A splicing head 9 is fastened on the cover plate 3 by two screws 7, 8. The splicing head 9 includes a splicing chamber or channel 10. The splicing chamber 10 is constructed in the form of a channel, which extends obliquely through the splicing head 9 and can be closed by a lid 11.

The fragmentary view of FIG. 1 clearly shows that two splicing air channels 12, 13 which are spaced apart from each other discharge into the splicing chamber 10. The splicing air channels originate from a central bore 14. The central bore can be connected to a stub or short pipe 16, which is suitable for connection to an air hose, as shown in FIG. 2.

Pneumatic holding devices 17, 18 are disposed at both sides of the splicing chamber 10 or splicing head 9. The devices 17, 18 serve for holding the ends of the threads during the thread preparation.

Figure 13:
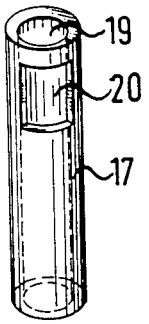
FIG. 13 is a perspective view of a pneumatic holding device.

The two pneumatic holding devices have the same construction. FIG. 13 shows the pneumatic holding device 17. The device 17 is constructed in the form of a tube with a central channel 19 for accepting the thread ends and a lateral opening 20 for injection air. The opening 20 has an approximately rectangular shape. A sheet metal cover 21 which is only seen in FIG. 1, may be disposed at the upper end of the splicing chamber or channel 10 so that it partly covers the splicing channel. A similar sheet metal cover 22 may be disposed at the lower end of the splicing channel 10. The basic body 2 may be provided with a sheet metal thread guide 23 at the top and with a similar sheet metal thread guide 24 at the bottom. A thread cutting device 25 is disposed above the thread guide 23 and a thread cutting device 26 is disposed below the thread guide 24. An additional sheet metal thread guide 27 is disposed above the thread cutting device 25 at the machine frame 6 and another sheet metal thread guide 28 is disposed below the thread cutting device 26.

The position of threads 29 and 30 after they have been inserted into the splicing chamber 10 but before they are cut, i.e. before respective thread ends 29', 30' are formed, is only shown in FIG. 1.

The thread 29 comes from the lower right, changes its direction at the cover 22, crosses through the splicing chamber 10, passes over the pneumatic holding device 17, and is conducted further upward toward the right through the opened thread cutting device 25. The thread 30 comes from the upper left, changes its direction at the cover 21, runs through the splicing chamber 10, passes over the pneumatic holding device 18, and is conducted downward toward the left through the opened thread cutting device 26.

Figure 4:
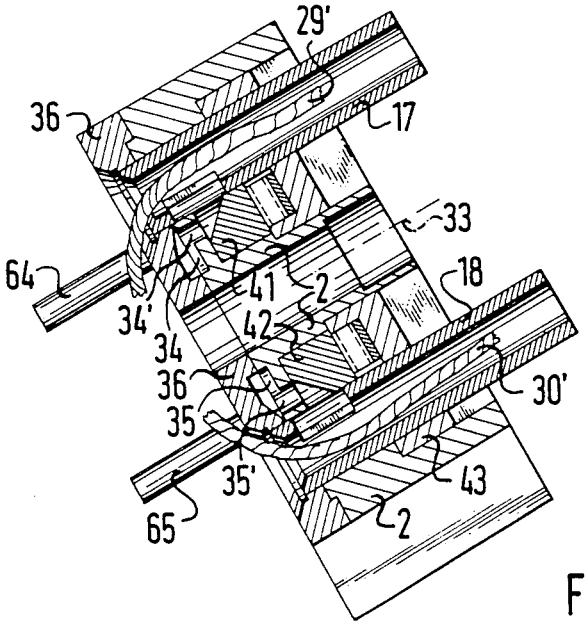
FIG. 4 is a cross-sectional view of the compressed air splicing device, taken along the line IV—IV in FIG. 3, in the direction of the arrows.
Figure 3:
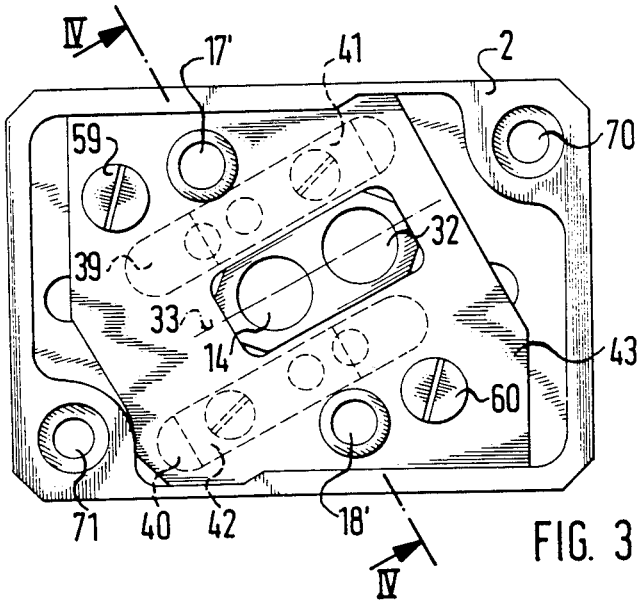
FIG. 3 is a bottom-plan view of the compressed air splicing device shown in FIG. 1.
Figure 5:
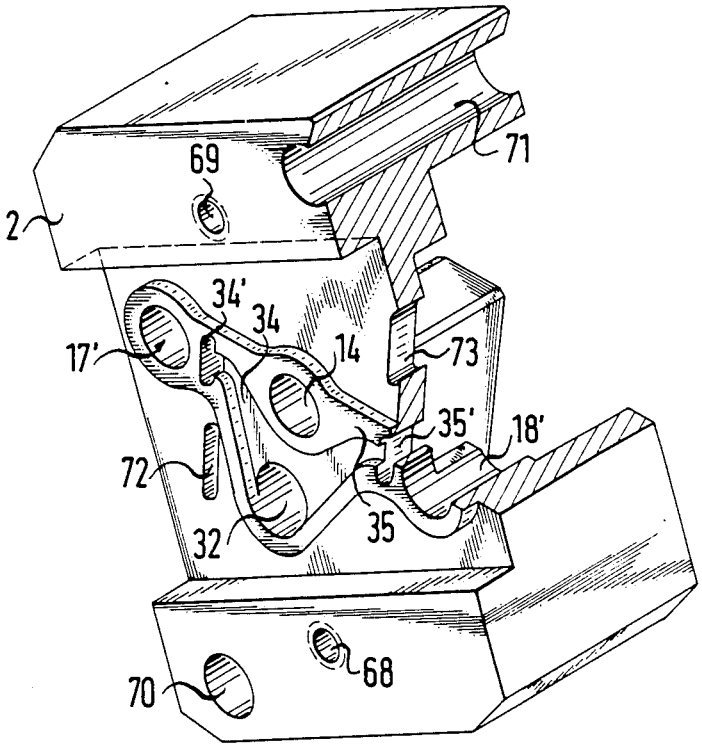
FIG. 5 is a partially cross-sectional perspective view of the basic body of the compressed air splicing device shown in FIG. 1.

According to FIG. 2, injection air can be supplied through a hose stub or connection pipe 31. The hose connection pipe 31 terminates in a main channel 32 which carries compressed air and is disposed in the basic body 2 parallel to the bore 14 carrying splicing air, as shown especially in FIGS. 5 and 6. The compressed air carrying main channel 32 is disposed in a plane of symmetry 33 of the pneumatic holding devices 17, 18, which are disposed in mirror symmetrical positions, as shown in FIGS. 3 and 4.

Figure 11:
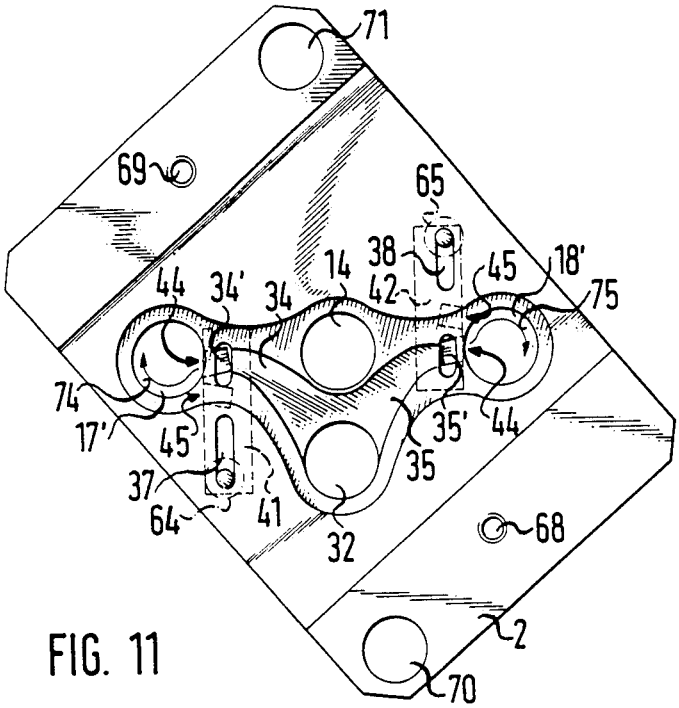
FIG. 11 is a view of the compressed air splicing device similar to FIG. 10, but with the injection air guide plate removed.
Figure 12:
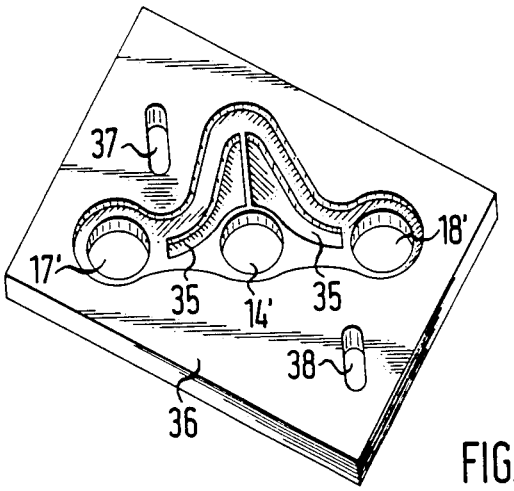
FIG. 12 is a bottom perspective view of the injection air guide plate.

According to FIGS. 4, 5, 11 and 12, compressed air supply channels 34, 35 originate from the main channel 32. It is seen especially in FIG. 4 that the compressed air supply channels 34 and 35 are formed by recesses which are partly in the basic body 2 and partly in an injection air guide plate 36. It is especially seen in FIG. 2 that the injection air guide plate 36 is clamped between the basic body 2, and the cover plate 3. The rectangular guide plate which is shown in FIG. 12, is provided with holes 17' and 18' for accepting the pneumatic holding devices, a hole 14' for continuing the bore 14 in the basic body 2 and two slots 37, 38 having a function which will be explained below.

Figure 6:
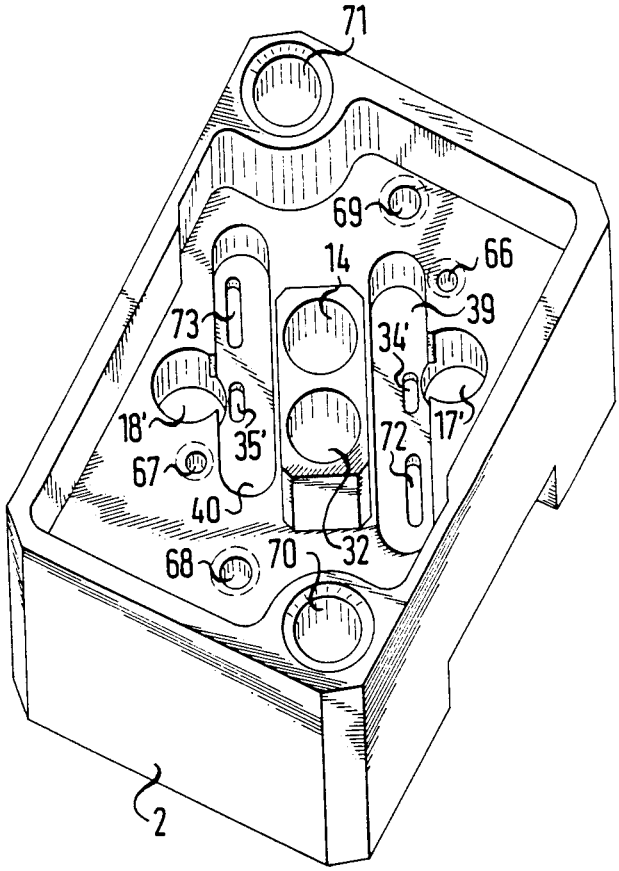
FIG. 6 is a bottom perspective view of the basic body shown in FIG. 5.
Figure 7:
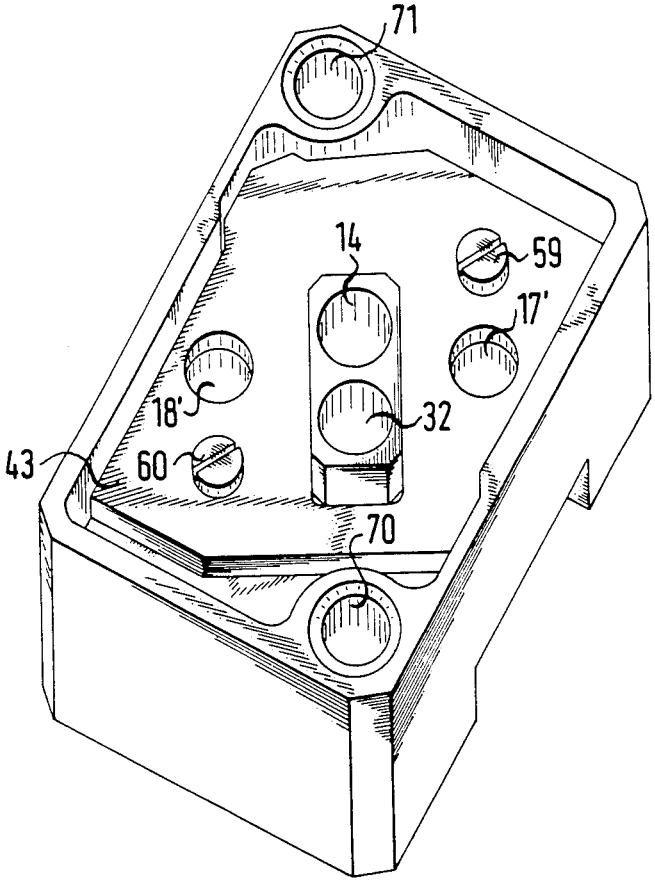
FIG. 7 is the same perspective view of the basic body shown in FIG. 6, but with the slider holding plate mounted in position.
Figure 9:
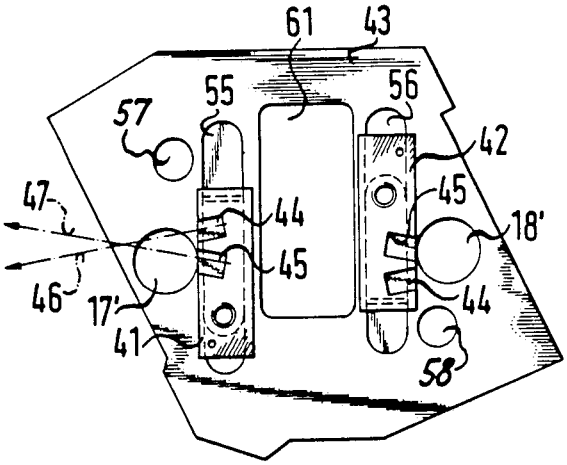
FIG. 9 is a bottom plan view of the slider holding plate with the slider in position.
Figure 14:
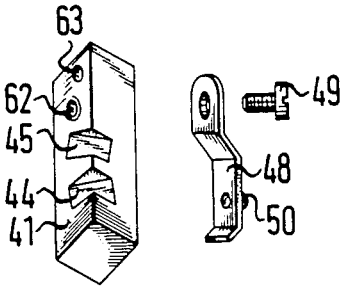
FIG. 14 is an exploded view of a slider with the associated parts.

Ends 34', 35' of the compressed air supply channels 34, 35 terminate in respective slider channels 39, 40, as shown in FIG. 6. According to FIGS. 3 and 4, a slider 41 is disposed in the slider channel 39 and a slider 42 is disposed in the slider channel 40. The two sliders 41 and 42 are similarly constructed. For example, the slider 41 is shown in FIG. 14. FIG. 9 shows views of the two sliders 41 and 42, which are mounted on a slider holding plate 43.

Each slider, such as the slider 41, is provided with two flow channels 44 and 45, according to FIG. 14. The flow channels 44 and 45 point in different directions 46, 47 and therefore determine the outflow direction of the injected air. The directions 46 and 47 are designated by arrows in FIG. 9. A leaf spring 48 is fastened by a screw 49 to the side of each respective slider which faces away from the flow channels 44, 45. The leaf spring 48 serves to secure the position of the respective slider 41, 42.

Figure 8:
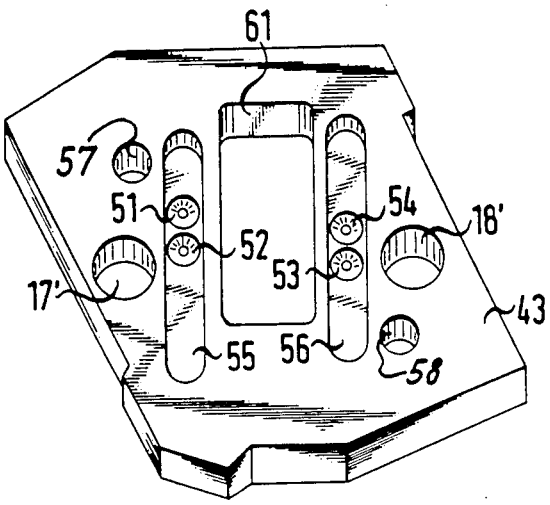
FIG. 8 is a bottom perspective view of the slider holding plate.

For this purpose, each leaf spring is provided with a projection 50, which engages in one of the depressions 51, 52, or 53, 54, which are provided in guide slots 55 or 56 in the slider holding plate 43 depending on the position of the slider, as shown in FIG. 8. Additionally, the slider holding plate 43 is provided with holes 17', 18' for the pneumatic holding devices, holes 57, 58 for fastening screws 59, 60 shown in FIG. 3, and a perforation or cutout 61.

According to FIG. 14, the sliders have a threaded bore 62 for accepting the screw 49 as well as a bore 63 for retaining a shift pin, which is provided with respective grips 64, 65 shown in FIG. 1, for setting the position of the slider. According to FIGS. 5 and 6, the basic body 2 has holes 17', 18' for accepting the holding devices 17, 18, threads 66, 67 for fastening the slider holding plate 43, threads 68, 69 for the screws 7, 8 which hold the basic body 2, the cover plate 3, and the splicing head 9 together, bores 70, 71 for the screws 4, 5 shown in FIG. 1, and elongated perforations or slots 72, 73 in the slider channels 39, 40 for the shift pins of the sliders 41, 42. The two shift positions of the sliders 41, 42 are shown especially in FIGS. 10 and 11.

According to FIG. 11, the flow channels 44 which are also seen in FIG. 14, lie under ends 34', 35' of the compressed air supply channels 34, 35. The outflowing or exiting injection air moves with right hand or clockwise rotation in the direction of the curved arrows 74, 75.

Figure 10:
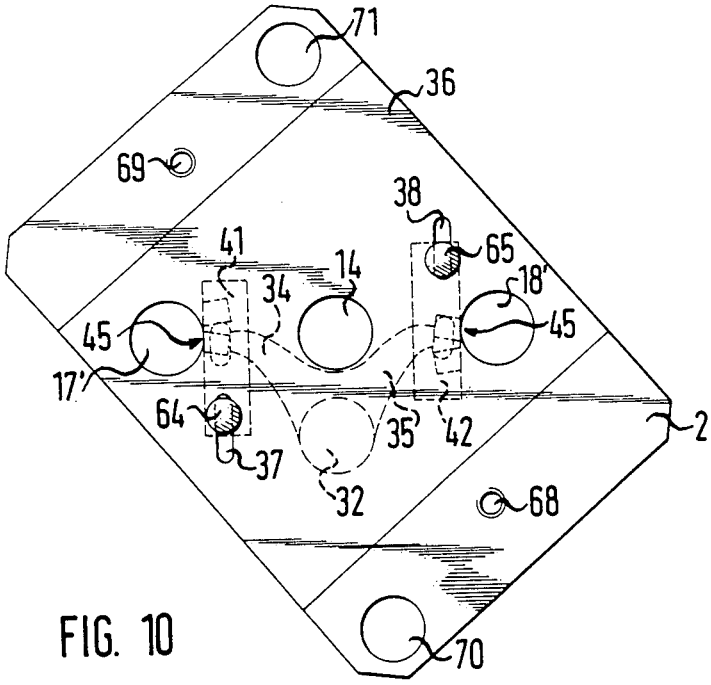
FIG. 10 is a view of the compressed air splicing device similar to FIG. 1, but without a splicing head which contains the splicing chamber.

In order to shift the sliders 41, 42, the grip 64 is pushed upward in a slot 37 and the grip 65 is pushed downward in a slot 38, according to FIG. 10. Accordingly, the flow channels 45 lie under the ends 34', 35' of the compressed air supply channels 34, 35. Entering injection air therefore rotates toward the left or counter-clockwise, i.e. in the opposite direction as it did in the slider position according to FIG. 11. After each slider shift, the leaf spring 48 ensures that the position of the slider is maintained.

The parts are assembled in the following manner: First, the leaf springs 48 are screwed to the sliders 41, 42. Then, the basic body 2 is brought to the position shown in FIG. 6. The slider 41 is subsequently inserted into the slider channel 39 and the slider 42 is placed into the slider channel 40. When installed, the leaf springs 48 point up and the flow channels 44, 45 point down and lie adjacent the holes 17', 18'. The slider plate 43 is then mounted and screwed to the basic body 2. The leaf springs 48 therefore lie in the guide slots 55 and 56 of the slider holding plate 43. The basic body 2 is then brought to the position shown in FIG. 11. The injection air guide plate 36 is mounted and covered by the cover plate 3. Then the splicing head 9 is placed onto the cover plate 3 and screwed to the basic body 2 together with the cover plate 3 and the injection air guide plate 36 by the screws 7 and 8. Before the screws are tightened, the pneumatic holding device 17 is inserted in the hole 17' and the pneumatic holding device 18 is inserted into the hole 18'. During this installation, the correct position of the openings 20 must be obtained. The openings 20 must point toward the symmetry plane 33 and must be perpendicular to the symmetry plane 33 in the sectional plane IV—IV shown in FIG. 3. It must be assured that one of the slider channels terminates in front of the opening 20, depending on the position of the sliders 41, 42. The shift pins are subsequently inserted through the slots 37, 38 and the perforations 72, 73 into the bores 63 in the sliders 41, 42.

After the parts are assembled, the compressed air thread splicing device 1 is fastened to the frame of the machine by the screws 4 and 5. The movable lid 11 is also supported at the machine frame 6 so that it can be opened and closed in a manner which will not be further explained herein. This also applies for the thread cutting devices 25 and 26. Finally, the hoses for compressed air are connected to the pipes 16 and 31. The thread splicing device 1 is then ready to operate.

The thread ends 29' and 30' shown in FIG. 1 and especially in FIG. 4, are generated by the action of the two thread cutting devices 25 and 26. At the same time that the threads are severed, compressed injection air is admitted through the pipe 31 and flows through the main channel 32 into the air supply channels 34, 35 and from there either through the flow channel 44 or through the flow channel 45 into the central channels 19 of the two pneumatic holding devices 17, 18. Depending on the position of the slider, spiral holding air currents which rotate either left or right are generated, causing the tightening, holding or loosening of the twist of the two thread ends, after the thread ends have been moved by the surrounding air stream into the end regions of the pneumatic holding devices 17 and 18.

For the splicing operation, the lid 11 is closed and compressed air is applied to the hose connection of the pipe 16. This compressed air flows as splicing air through the bores 14, 14' and enters the splicing chamber 10 through the splicing air channels 12 and 13. Before this takes place, the two threads 29 and 30 can be retracted by special non-illustrated means, so that the thread ends 29' and 30' are almost completely inside of the splicing channel 10.

After the splice is completed, the splicing air is shut off and the lid 11 is opened so that the joined thread can be taken out. The injection air is also shut off, at the latest when the splicing air is shut off.

The invention is not limited to the illustrated and described embodiment which was used as an example. For example, if the parts 2, 36, 41, 42 and 43 are made of a thermoplastic synthetic material, several screw connections can be omitted, because the parts 36 and 43 can then be connected with the part 2 by ultrasonic welding or by cementing.

I claim:

1. Compressed air thread splicing device for producing a thread connection by splicing, comprising a splicing chamber having at least one opening formed therein through which compressed air is blown into said splicing chamber for mutually entangling, hooking, intermingling and winding fibers of threads to be spliced together in said splicing chamber, pneumatic holding devices disposed at two sides of said splicing chamber for holding ends of the threads to be prepared for splicing at a given location between said pneumatic holding devices and said splicing chamber, each of said holding devices having a channel for receiving a thread end and a lateral opening for receiving injection air generating a holding air current, a slider having flow channels with ends formed therein for each of said holding devices pointing in different discharge directions, said ends of said flow channels and said lateral openings being disposed substantially vertically below said given location, a compressed air supply channel, and means for alternately conducting the injection air through said flow channels to said lateral opening for determining the discharge direction of the injection air, said injection air conducting means being in the form of means for shifting said slider between a first position in which one of said flow channels is connected to said compressed air supply channel and a second position in which the other of said flow channels is connected to said compressed air supply channel.

2. Compressed air thread splicing device according to claim 1, wherein said pneumatic holding devices have a plane of symmetry, said compressed air supply channels are mirror-symmetrical, have the same length, have the same cross section and are free of obstructions, and including a main channel in said plane of symmetry being connected to said compressed air supply channels.

* * * * *